US005865252A

United States Patent [19]

van Petegem et al.

[11] Patent Number: 5,865,252

[45] Date of Patent: Feb. 2, 1999

[54] ONE-TRIP WELL PERFORATION/ PROPPANT FRACTURING APPARATUS AND METHODS

[75] Inventors: Ron van Petegem, Sandnes, Norway; Perry C. Shy, Southlake, Tex.; David L. Reesing, Irving, Tex.; Alan T. Jackson, Plano, Tex.

[73] Assignee: Halliburton Energy Services, Inc., Dallas, Tex.

[21] Appl. No.: 792,743

[22] Filed: Feb. 3, 1997

[51] Int. Cl.[6] ..... E21B 43/116

[52] U.S. Cl. ..... 166/297; 166/308

[58] Field of Search ..... 166/297, 308, 166/298, 55, 177.5, 332.4

[56] References Cited

U.S. PATENT DOCUMENTS

| | | | |
|---|---|---|---|
| 4,269,278 | 5/1981 | Vann | 175/4.51 |
| 5,361,843 | 11/1994 | Shy et al. | 166/297 |
| 5,390,742 | 2/1995 | Dines et al. | 166/297 |
| 5,598,891 | 2/1997 | Snider et al. | 166/297 X |
| 5,704,426 | 1/1998 | Rytlewski et al. | 166/297 |

*Primary Examiner*—William P. Neuder
*Attorney, Agent, or Firm*—Paul I. Herman; J. Richard Konneker

[57] ABSTRACT

In a subterranean well a one-trip production zone perforation and proppant fracturing operation is carried out using a workstring-supported perforation gun lowered into a casing nipple located in the production zone. Firing of the gun creates spaced apart aligned sets of perforations extending outwardly through a side wall portion of the workstring, the nipple, the surrounding cement, and into the production zone, after which the gun falls into and is retained in an underlying gun catcher portion of the workstring. While an overpull force is maintained on the workstring above the perforations, a proppant slurry is pumped down the workstring, out its sidewall perforations, and outwardly through the aligned perforation sets formed in the nipple, cement and production zone. After stimulation of the production zone, the workstring and the spent perforation gun that it retains are pulled up, with the upwardly moving workstring positioning a sliding closure device inwardly over the perforations to isolate the stimulated production zone until the well is readied for production. Illustrated alternate embodiments include the use of a low debris casing gun in place of the drop-off type perforating gun, the use of pre-formed wide wall perforations in the workstring side wall, and a one-trip perforation and production flow creating method in which the production zone stimulating step is eliminated.

43 Claims, 5 Drawing Sheets

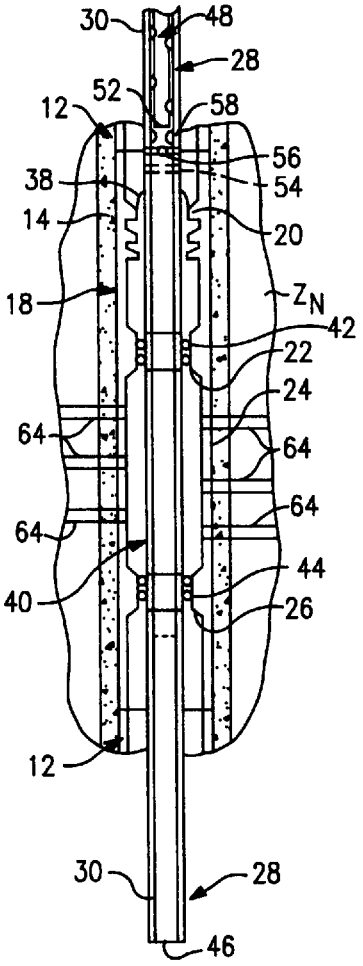
FIG. IB
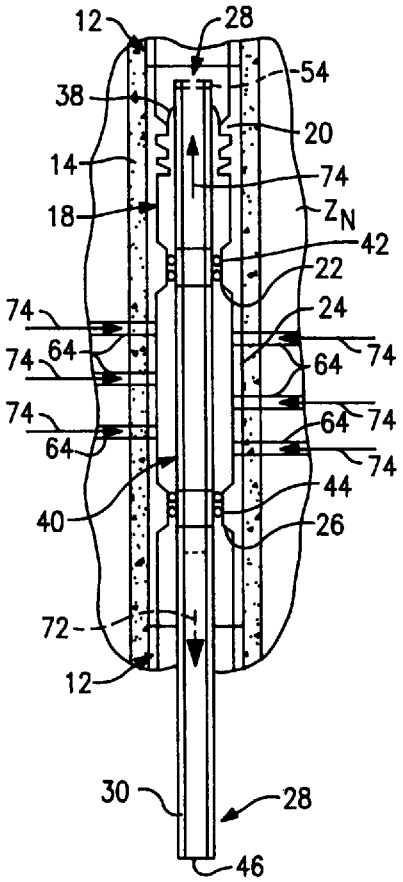
FIG. IC

ONE-TRIP WELL PERFORATION/ PROPPANT FRACTURING APPARATUS AND METHODS

BACKGROUND OF THE INVENTION

The present invention generally relates to tools used in subterranean wells and, in a preferred embodiment thereof, more particularly relates to apparatus and methods for conducting perforation and related formation fracturing operations in subterranean wells.

A potentially productive geological formation beneath the earth's surface often contains a sufficient volume of valuable fluids, such as hydrocarbons, but also has a very low permeability. "Permeability" is a term used to describe that quality of a geological formation which enables fluids to move about in the formation. All potentially productive subterranean formations have pores, a quality described using the term "porosity", within which the valuable fluids are contained. If, however, the pores are not interconnected, the fluids cannot move about and, thus, cannot be brought to the earth's surface without a structural modification of the production zone.

When such a formation having very low permeability, but a sufficient quantity of valuable fluids in its pores, is desired to be produced, it becomes necessary to artificially increase the formation's permeability. This is typically accomplished by "fracturing" the formation, a practice which is well known in the art and for which purpose many methods have been conceived. Basically, fracturing is achieved by applying sufficient pressure to the formation to cause it to crack or fracture, hence the term "fracturing" or simply "fracing". The desired result of this process is that the cracks interconnect the formation's pores and allow the valuable fluids to be brought out of the formation and to the surface.

Using previously proposed apparatus and methods, the general sequence of steps needed to stimulate a production zone through which a wellbore extends is as follows. First, a perforable nipple is made up in the well casing, and cemented in, at a predetermined depth in the well—i.e., within the subterranean production zone requiring stimulation. Next a perforating trip is made by lowering a perforation assembly into the nipple on a lower end portion of a tubular work string. The gun assembly is they detonated to create a spaced series of perforations extending outwardly through the nipple, the casing, the cement and into the production zone. The discharged gun assembly is then pulled up with the workstring to complete the perforating trip.

Next, the spent gun assembly is replaced on the workstring with a tubular proppant discharge member having a spaced series of sidewall proppant slurry discharge openings formed therein, the discharge openings being at least theoretically alignable with the gun-created perforations extending outwardly through the now perforated nipple in the well. With the proppant discharge member in place, the workstring is again lowered into the well (typically with one or more stimulation packers thereon) until the proppant discharge member is within the nipple. Proppant slurry is then pumped down the workstring so that proppant slurry is discharged through the discharge member side wall outlet openings and then flowed outwardly through the nipple and cement perforations into the corresponding perforations in the surrounding production zone. The workstring is then pulled out again to complete the stimulation trip and ready the casing for the installation therein of production tubing and its associated production packer structures.

This previously proposed perforation and proppant fracturing technique has several well known and heretofore unavoidable problems, limitations and disadvantages. For example, it requires two separate trips into the well to respectively carry out the necessary perforation and fracturing procedures.

Additionally, when the proppant slurry discharge member is lowered into the perforated nipple it is, as a practical matter, substantially impossible to obtain a precise alignment (in both axial and circumferential directions) between the between the side wall discharge openings in the proppant slurry discharge member and the gun-created perforations in the nipple. The usual result of this discharge opening/nipple perforation misalignment is that after it is discharged from the workstring, the proppant must follow a tortuous path on its way to entering the nipple perforations. Because of the highly abrasive character of proppant slurry, this tortuous flow path can easily cause severe abrasion wear problems in the casing.

Using this previously proposed perforation and proppant fracturing technique also limits the ability to isolate multiple production zones from one another—a requirement that may easily arise due to the fact that different zones may require different fracturing pressures and total amounts of proppant. This problem can be partially alleviated by using straddle packers at each zone. However, each zone requires a separate trip with packers, and the retrieval of the packers can be quite difficult.

Moreover, there is a lack of immediate (i.e., right after proppant fracturing) proppant flow-back control. After the production zone is stimulated using this technique, proppant flow-back can easily occur when the proppant pumping pressure is relaxed, or later when the well is producing. Such proppant flow-back creates a variety of problems, such as abrasion of production equipment, or reduction in the production rate of the stimulated formation.

Finally, the previously proposed perforation and proppant fracturing technique described above lacks the ability to provide well pressure balance control during pre-production trips, thereby tending to create undesirable unbalanced pressure situations during the completion of the well.

As can be readily seen from the foregoing, it would be highly desirable to provide improved perforation and proppant fracturing apparatus and methods which eliminate or at least substantially reduce the above-mentioned problems, limitations and disadvantages commonly associated with the previously proposed perforation/stimulation technique generally described above. It is accordingly an object of the present invention to provide such improved apparatus and methods.

SUMMARY OF THE INVENTION

In carrying out principles of the present invention, in accordance with a preferred embodiment thereof, a one-trip method of perforating and stimulating a subterranean well production zone is provided which at least substantially reduces the above-mentioned problems, limitations and disadvantages commonly associated with conventional multi-trip perforation/stimulation techniques as previously utilized.

From a broad perspective, the one-trip perforation and stimulation method of the present invention is carried out by extending a wellbore through the production zone and positioning a perforable tubular member in the wellbore within the production. Preferably the perforable tubular member is a dedicated perforable nipple cemented-in with the balance of a casing structure formed in the wellbore.

A tubular workstring is lowered into the wellbore in a manner positioning a predetermined longitudinal portion of the workstring within the tubular member. This longitudinal workstring portion interiorly supports a drop-off type perforating gun which, when fired, is automatically released from the workstring and falls downwardly therethrough. After positioning thereof in the perforable nipple, the gun is fired to create a spaced series of first perforations in the side wall of the lowered longitudinal workstring portion, and a spaced series of second perforations aligned with the first perforations and extending outwardly through the side wall of the nipple and into the production zone. Alternatively, the first perforations are pre-formed in the longitudinal workstring portion before it is lowered into the well, and the gun fires directly outwardly through these pre-formed workstring side wall perforations. Seal structures carried by the workstring engage longitudinally spaced apart seal surface areas on the interior of the nipple to isolate the perforable side wall portion thereof from the balance of the nipple.

Positioned below the supported gun within the workstring is a check valve structure operative to permit fluid flow upwardly therethrough but preclude fluid flow downwardly therethrough. Upwardly adjacent the check valve within the workstring is an inwardly projecting catch structure, representatively a no-go structure, which is spaced downwardly apart from the lower end of the gun a distance at least equal to the axial length of the gun. After the gun is fired it drops downwardly through the workstring to below the first perforations and is stopped by the catch structure and retained within the workstring for subsequent retrieval therewith from the wellbore.

The workstring preferably has a locator key installed thereon above the gun-carrying longitudinal portion of the workstring, and the gun is operatively positioned within the perforable nipple by lowering the locator key through an internal profile within the nipple to a location below the nipple, with the workstring then being pulled upwardly to engage the key in the nipple profile. The engaged key releasably prevents its upward passage through the profile. Prior to the firing of the gun, and with the locator key engaged with the nipple profile, a substantial overpull tension force is exerted on the portion of the workstring above the locator key and maintained during the firing of the gun.

This overpull force on the workstring is also maintained after the firing of the gun while a suitable stimulating fluid, such as a proppant slurry, is forced downwardly through the workstring, outwardly through the first perforations and into the production zone through the second perforations which are aligned both axially and circumferentially with the first perforations. The overpull force being maintained on the workstring automatically maintains the originally created alignment between the first and second perforations and compensates for thermal and mechanical forces that are exerted on the workstring during the slurry pumping operation and might otherwise cause misalignment between the first and second perforations.

If desired, after the proppant slurry pumping step is completed, the workstring may be lowered again and a cleanout fluid, such as a brine solution, pumped downwardly through the workstring, outwardly through the first perforations, and then upwardly through the annulus between the workstring and the well casing, to clean out residual proppant slurry from within the casing.

Next, a sufficient upward force is exerted on the workstring, with the locator key operatively received in its associated nipple profile, to disable the key and permit its upward movement through the nipple profile. In conjunction with this operation, at least a portion of the workstring, including the longitudinal portion thereof in which the spent perforating gun is retained, is pulled out of the well. According to another feature of the present invention, in response to this workstring removal step, the second perforations are covered, in a manner preventing appreciable fluid inflow through the second perforations, with a fluid control member subsequently shiftable relative to the nipple to permit fluid inflow through the second perforations. This step serves to controllably isolate the stimulated production zone from the casing until well fluid production from the zone is subsequently desired.

In one embodiment of the apparatus used to perform this one-trip method, a lower end section of the workstring extends downwardly beyond the check valve. Mounted on this lower end section, from top to bottom along its length, are a releasably connection structure, a locking key, and a tubular sliding side door structure. After the locator key above the gun is disabled and passed upwardly through the nipple profile, the locking key is moved into and locked within the nipple profile. At this point the sliding side structure, in its closed orientation, is sealingly moved into place inwardly over the second perforations. Next, a sufficient upward force is exerted on the workstring portion above the releasable connection therein to separate the workstring at such connection, leaving the sliding side door in place in its closed orientation within the nipple. The upward balance of the workstring, including the longitudinal portion thereof in which the spent perforating gun is retained, is then pulled out of the well. Using a suitable conventional shifting tool lowered into the well, the closed sliding side door structure may later be opened to permit well fluid from the now stimulated production zone to flow through the second perforations into and upwardly through the casing to the earth's surface.

In a second embodiment of the apparatus used to perform the one-trip perforation and stimulation method, the releasable connection structure, the locking type locator key and the sliding side door structure on the lower workstring end section beneath the check valve are eliminated and replaced with a tubular fluid flow control sleeve shifter member, and an axially shiftable tubular fluid flow control sleeve is slidably and sealingly disposed in an open position thereof within the nipple beneath its perforable side wall portion. After the workstring locator key disposed above the perforating gun is disabled and passed upwardly through the nipple profile, the entire workstring is retrieved from the well. As the shifter member on the lower end of the workstring approaches the tubular sleeve it sequentially engages it, shifts it upwardly to its closed position in which the closed sleeve inwardly and sealingly blocks the second perforations, and then disengages from the upwardly shifted sleeve to be retrieved with the workstring.

The one-trip perforation and stimulation technique of the present invention provides a variety of advantages over conventional production zone perforation and stimulation apparatus and methods. For example, instead of the typical multiple downhole trips needed, the present invention uniquely performs the perforation and stimulation operations in a single downhole trip. Additionally, due to the maintenance of alignment between the first and second perforations, abrasion damage during the proppant slurry pumping phase of the process is substantially reduced due to the elimination of a tortuous slurry path prior to its entry into the casing perforations. This perforation alignment feature also at least potentially reduces the required proppant slurry pressure required.

Moreover, after the proppant slurry is pumped into the production zone the stimulated zone is then automatically isolated from the casing and the other production zones during the termination of the same single downhole trip—i.e., as the workstring is pulled out of the well. This automatic isolation feature of the invention further desirably provides for well pressure balance control during the subsequent perforation and stimulation of other production zones in the subterranean well. Finally, the one-trip method of this invention automatically provides for immediate proppant flow-back control, by shutting off the second perforations, at the end of the stimulation portion of the method.

While the axial force exerted on the workstring to maintain the alignment between the first and second perforations is preferably an overpull tension force, it could also be an axial compression force. Additionally, while the one-trip method of the present invention may be advantageously utilized to perforate and stimulate a production zone, it may also be used to perforate and then create a resulting production fluid upflow through the side wall perforations in the still lowered workstring by simply eliminating the stimulating step and permitting the production zone fluids to flow inwardly through the workstring side wall perforations.

Moreover, instead of utilizing a drop-off type perforation gun within a longitudinal portion of the workstring to be perforated by the gun prior to the production zone stimulation step, in an alternate method of the present invention a low debris casing gun is utilized and installed in-line with the workstring, thereby placing the individual detonation portions of the gun in direct facing relationship with the perforable side wall portion of the nipple. This eliminates the need to drop and then catch the gun, thereby shortening the overall workstring length. After firing the gun the detonation portions create first side wall perforations in the tubular housing of the gun which are aligned with the resulting second perforations extending through the nipple, the cement and into the production zone. The proppant slurry may then be pumped downwardly through the interior of the still in-place gun housing and outwardly through its side wall perforations. Alternatively, if the stimulation step is not used, production fluid may be flowed inwardly through the gun side wall perforations and upwardly therethrough into the workstring for delivery therethrough to the surface.

BRIEF DESCRIPTION OF THE DRAWINGS

FIGS. 1A–1C are schematic cross-sectional views through the lowermost perforable nipple and sequentially illustrate the performance in the well of a perforation and proppant stimulation operation embodying principles of the present invention;

DETAILED DESCRIPTION

Figure 1:
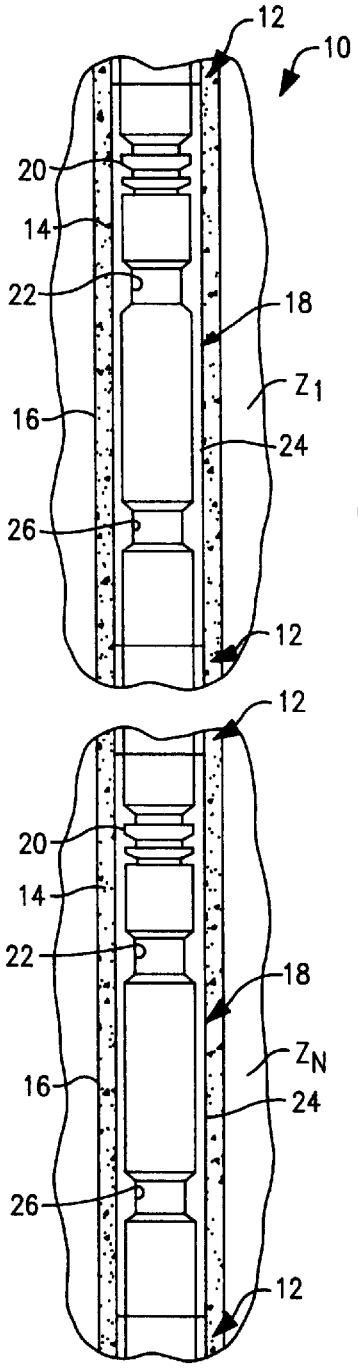
FIG. 1 is a schematic cross-sectional view through a longitudinally foreshortened vertical portion of a subterranean well, including two dedicated perforable casing nipples, extending through two representative production zones.

Cross-sectionally illustrated in FIG. 1 in schematic form is a longitudinally foreshortened representatively vertical portion of a subterranean well 10 that extends through a spaced plurality of production zones Z including an uppermost production zone $Z_1$ and a lowermost production zone $Z_N$. Well 10 includes a metal casing 12 cemented, as at 14, into a wellbore 16 and having at each production zone a perforable nipple portion 18. Each nipple 18 has, from top to bottom along its interior, an annular locator profile 20, a reduced diameter top annular seal surface 22, a radially thinned tubular perforable side wall area 24, and a reduced diameter bottom annular seal surface 26.

Figure 1A:
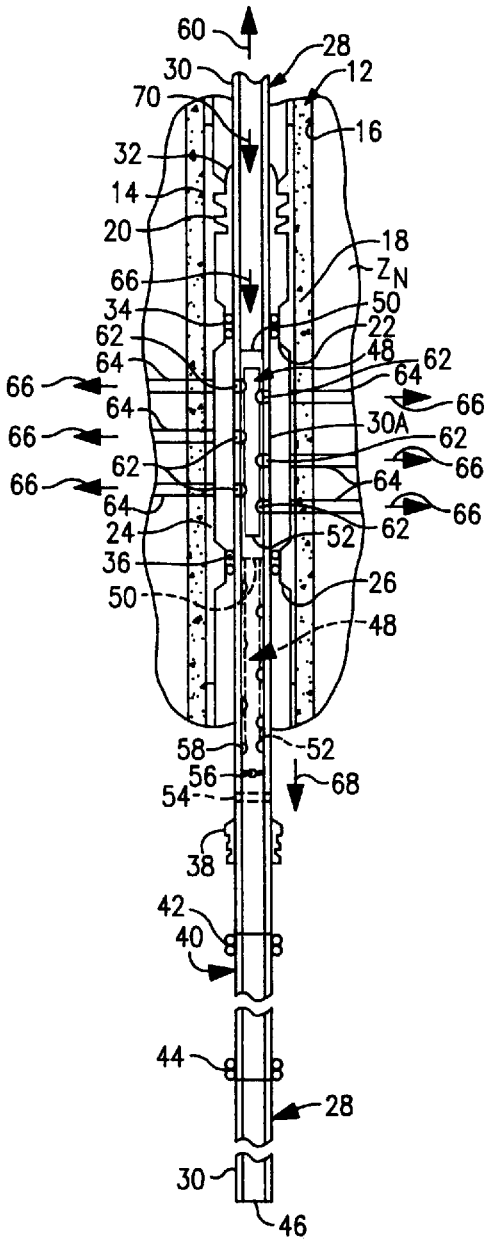

Turning now to FIG. 1A, in which the lowermost nipple 18 is representatively illustrated, the present invention provides for each of the production zones Z a unique one-trip perforation and stimulation process which yields, as later described herein, a variety of improvements over conventional multi-trip production zone stimulation techniques. To carry out this one-trip process a specially designed tubular workstring assembly 28 is used.

Workstring assembly 28 includes a length of workstring tubing 30 which is extendable downwardly through the wellbore casing 12, and its perforable nipple portions 18, as later described herein. The lower end portion of the workstring assembly 28 illustrated in FIG. 1A includes, from top to bottom, (1) a conventional locator key 32 exteriorly mounted on the tubing 30; (2) an upper annular seal structure 34 externally carried on the tubing 30; (3) a longitudinal gun carrying portion 30*a* of the tubing 30; (4) a lower annular seal structure 36 externally carried on a longitudinally intermediate section of the gun carrying tubing portion 30*a*; (5) a locking type locator key 38; (6) a conventional screened tubular sliding side door assembly 40 having upper and lower external annular end seals 42 and 44 and installed in its closed position in the workstring assembly 28; and (7) an open lower end 46 of the tubing 30.

The locator key 32 is of a conventional construction and may be passed downwardly through the nipple profile 20, but once the key 32 has passed downwardly through the profile 20 the profile functions to engage key 32 and prevent it from passing upwardly through the profile 20. However, when sufficient upward force is exerted on the key 32 it may be disabled to permit it to be moved upwardly through the profile 20. Locator key 32 could alternatively be another type of locator device known in this art, such as, for example, a collet, slugs or C-rings.

A conventional drop-off type perforating gun 48, having upper and lower ends 50 and 52, is operatively supported within an upper end section of the gun carrying portion 30*a* of the workstring tubing 30. The lower end of the workstring gun carrying portion 30*a* is connected to the portion of the workstring tubing 30 below it by a suitable releasable connection 54 such as, for example, that typically used in a lock mandrel running tool. Directly above the releasable connection 54, within the tubing 30, is a standing check valve structure 56 that functions to permit upward fluid flow therethrough and preclude downward fluid flow therethrough. The standing check valve 56 is directly below an internal no-go structure 58 which, as later described herein, functions to catch the perforating gun 48 after it has been fired and drops off its mounting structure within the tubing 30. Check valve 56 could alternatively be positioned above the gun 48, with a suitable plug structure disposed below the gun, and thus still function to permit fluid flow into the tubular workstring structure while precluding fluid flow outwardly therefrom.

Still referring to FIG. 1A, when it is desired to perforate and stimulate the illustrated subterranean production zone $Z_N$ the illustrated lower end portion of the workstring assembly 28 is lowered through the casing 12 until the locator key 32 is positioned beneath the nipple 18 disposed within the production zone $Z_N$. Workstring assembly 28 is then raised to its FIG. 1A position in which (1) the locator key 32 is operatively engaged by the nipple profile 20 to stop further upward movement of the workstring assembly 28; (2) the perforating gun 48 is disposed between the upper and lower internal nipple seal areas 22 and 26, with the side of the gun facing the perforable side wall area 24 of the nipple 18; and (3) the upper and lower tubing seals 34,36 respectively engaging the upper and lower nipple areas 22,26 and thereby sealing off the interior of the perforable nipple area 24 from the interior nipple portions above and below it.

Next, as indicated by the arrow 60 in FIG. 1A, the portion of the workstring tubing above the locator key 32 is tensioned by creating a substantial overpull force therein, representatively about 20,000 pounds of upward force. The gun 48 is then fired to create a spaced series of first perforations 62 in the side wall of the gun carrying workstring portion 30*a*, and a spaced series of second perforations 64 aligned with the first perforations 62 and extending outwardly through the perforable nipple side wall area 24, the cement 14 and into the production zone $Z_N$.

Alternatively, the first perforations 62 may be pre-formed in the gun carrying workstring portion 30*a*, before it is lowered into the casing 12, and appropriately aligned with the series of detonation portions on the perforating gun 48. When the gun is later fired, it fires directly outwardly through the pre-formed perforations 62, thereby reducing the overall metal wall thickness which the gun must perforate.

After the firing thereof, and the resulting provision of the circumferentially and axially aligned sets of perforations 62 and 64, the gun 48 automatically drops-off its mounting structure within the tubing 30 and falls downwardly through the tubing 30 to the dotted line position of the gun 48 in which it is caught within a lower end section of the workstring gun carrying portion 30*a* by the no-go structure 58. In this "caught" position of the dropped gun 48 its upper end 50 is disposed beneath the lowermost aligned perforation set 62,64 as indicated in FIG. 1A.

After the perforation gun 48 drops, and while still maintaining the overpull force 60 on the tubing 30 above the locator key 32, the production zone $Z_N$ is stimulated by pumping stimulation fluid, such as a suitable proppant slurry 66, downwardly through the workstring tubing 30, outwardly through the tubing perforations 62 and into the production zone $Z_N$ through the perforations 64 which are aligned with the perforations 62 both circumferentially and axially.

At this point it is important to note that the stimulation process for the representative production zone $Z_N$ has been completed not with the usual plurality of downhole trips, but instead with but a single trip with the workstring. Additionally, and in accordance with another feature of the present invention, during the pumping and workstring discharge of the proppant slurry 66, the workstring discharge perforations 62 are kept in their initial firing alignment with the nipple, cement and production perforations 64. The high pressure streams of proppant slurry 66 exiting the workstring discharge perforations 62 are jetted essentially directly into their corresponding aligned perforations 64, thereby eliminating the conventional tortuous path, and resulting abrasion wear problems, of discharged proppant slurry resulting from perforation misalignments occurring in conventional multi-trip stimulation operations. Additionally, this perforation alignment feature also at least potentially reduces the stimulation pumping pressure required.

The maintenance of the desirable, abrasion reducing alignment between the perforations sets 62 and 64 during the proppant slurry phase of the overall stimulation process is facilitated by the previously mentioned overpull force 60 maintained during slurry pumping. Such overpull force, coupled with the forcible upward engagement of the locator key 32 with the corresponding nipple locator profile 20, automatically builds into the tubing 30 compensation for thermal and pressure forces imposed on the tubing 30 during proppant slurry delivery that otherwise might shift the perforations 62 relative to their directly facing perforations 64.

While the axial force used to maintain the alignment between the perforations 62,64 is preferably a tension force, it could alternatively be an axial compression force maintained on the portion of the workstring 30 above the key 32. To use this alternate compression force it is simply necessary to reconfigure the key 32 so that will pass upwardly through the nipple profile 20 but is releasably precluded from passing downwardly therethrough.

If desired, after the proppant slurry pumping step is completed a cleanout step may be carried out to remove residual proppant slurry from the interior of nipple 18. To do this, the overpull force 60 is relaxed, and the workstring assembly 28 is lowered, as indicated by the arrow 68 in FIG. 1A, until the upper annular seal structure 34 on the tubing 30 moves downwardly past its corresponding upper nipple seal area 22. A suitable cleaning fluid 70 (such as a brine solution) is then pumped downwardly through the workstring tubing 30, outwardly through the tubing side wall perforations 62, and then upwardly through the annular space between the nipple 18 and the workstring, to upwardly flush out residual proppant slurry from the nipple interior.

After this optional cleanout step is performed, the workstring is raised again to return it to its FIG. 1A position in which the locator key 32 is received in and upwardly abuts the nipple profile 20. The workstring 30 is then pulled upwardly with a force sufficient to "shear out" and disable the locator key 32, thereby permitting the locator key 32 to pass upwardly through the nipple profile 20, and then further pulled upwardly until, as indicated in FIG. 1B, the locking locator key 38 locks into the nipple profile 20 to halt further upward workstring movement. At this point, the annular upper and lower sliding side door end seals 42,44 sealingly engage the annular internal nipple sealing surface areas 22 and 26, respectively, with the screened tubular sliding side door structure 40 longitudinally extending between the sealing surfaces 22,26.

Finally, an upward pull is exerted on the portion of the workstring tubing 30 above the locking locator 38 with sufficient force to separate the workstring assembly at the releasable connection 54, thereby leaving the indicated lower longitudinal portion of the workstring assembly 28 in place within the nipple 18 as indicated in FIG. 1C. If the previously described optional slurry cleanout step is not performed, this step is performed directly after the slurry supply pumping portion of one-trip perforation and stimulation process.

As can be seen by comparing FIGS. 1B and FIG. 1C, a further desirable feature of the one-trip method is that the spent perforating gun 48 is automatically retrieved with the upper workstring portion upon completion of the method instead of being simply dropped into the well's rat hole as is typically the case when a drop-off type perforating gun is used in conventional multi-trip perforation and stimulation methods.

Still referring to FIG. 1C, as previously mentioned, the screened sliding side door structure 40 was initially installed in its closed position in the workstring assembly 28. Accordingly, the sliding side door structure 40, when left in place within the nipple 18 at the end of the one-trip perforation and stimulation process, serves to isolate the stimulated production zone $Z_N$ from the balance of the well system by blocking inflow of production fluid from production zone $Z_N$ through the perforations 64 and then upwardly through either the workstring tubing 30 or the nipple 18.

The overall method just described is thus utilized, in a single downhole trip, to sequentially carry out in a unique fashion a perforation function, a stimulation function, and a subsequent production zone isolation function. As will be readily appreciated, similar one-trip methods may be subsequently performed on upwardly successive ones of the production zones Z to perforate, stimulate, and isolate them in readiness for later well fluid delivery therefrom.

After each subterranean production zone Z has been readied for well fluid delivery in this manner, any zone (for example, the production zone $Z_N$ shown in FIG. 1C) may be selectively re-communicated with the interior of its associated workstring section simply by running a conventional shifting tool (not shown) down the well and using it to downwardly shift the door portion of the selected zone's sliding side door structure 40, as indicated by the arrow 72 in FIG. 1C, to thereby permit production fluid 74 to flow from the production zone $Z_N$ inwardly through its perforations 64, into the now opened screened sliding side door structure 40, and then upwardly through the workstring section 30 and the casing 12 to the surface. Alternatively, of course, the sliding side door structure could be rotationally shiftable between its open and closed positions instead of axially shiftable therebetween.

Figure 3:
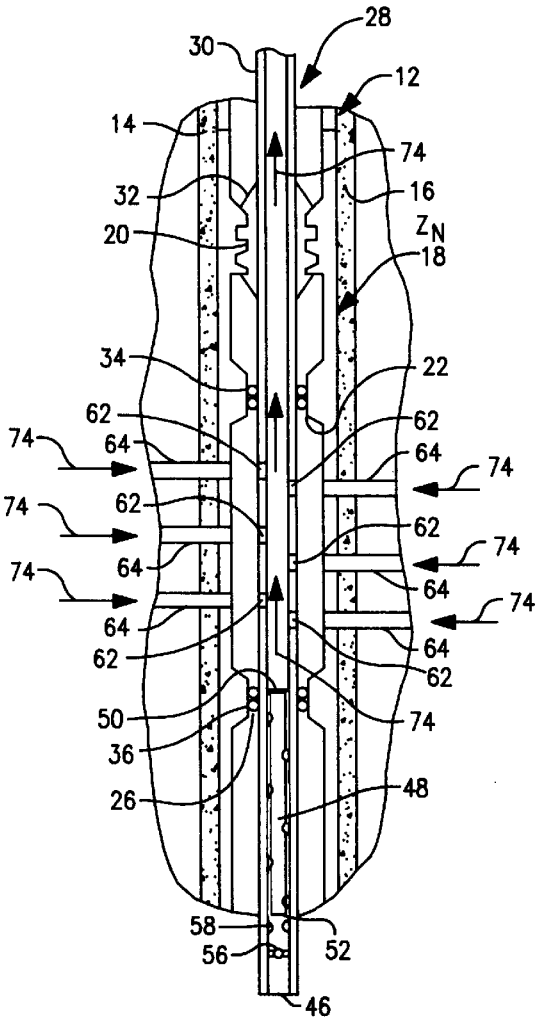
FIG. 3 is a schematic cross-sectional view similar to that in FIG. 1A and partially illustrates an alternate one-trip perforation and production flow producing method embodying principles of the present invention.

While the present invention, as described above, provides a unique one-trip perforation, stimulation and subsequent production zone isolation method, principles of the invention may also be used to provide a one-trip perforation and production flow creating method without the use of its stimulation portion as schematically illustrated in FIG. 3. Specifically, representatively using a slightly modified version of the previously described apparatus of FIG. 1A, after the gun 48 has been fired and permitted to drop and be caught within an underlying longitudinal portion of the workstring 30, the previously described proppant slurry pumping step is simply eliminated and production zone fluid 74 permitted to flow inwardly through the perforations 64, the perforations 62, and then upwardly through the still lowered workstring 30 to the surface.

As may be seen by comparing the workstring apparatus in FIG. 3 to that in FIG. 1A, in the FIG. 3 version of such apparatus the releasable connection 54, the locking key 38 and the sliding side door 40 are eliminated from the FIG. 3 workstring apparatus, with the open lower workstring end 46 being positioned immediately below the standing check valve 56.

Figure 4:
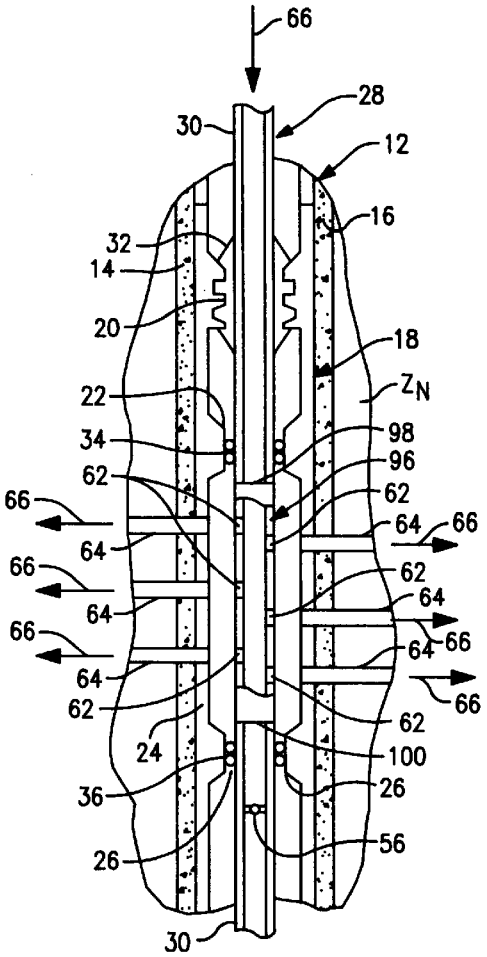
FIG. 4 is a schematic cross-sectional view illustrating the use of a low debris type in-line casing gun in place of the drop-off type perforating gun shown in FIGS. 1A and 2A.

Shown in FIG. 4 is the use of a conventional low debris in-line casing gun 96 used in place of the previously described drop-off type perforating gun 48. The gun 96 has a top end 98 and a bottom end 100 and, instead of being mounted within a longitudinal portion of the workstring 30 for released movement axially therethrough, is axially interposed between adjacent portions of the workstring with the tubular housing of the gun 96 defining, in effect, a longitudinal portion of the overall workstring structure. Firing of the gun 96 just prior to the previously described proppant slurry pumping step creates the first perforations 62 directly in the gun housing side wall, with the perforations 62 being aligned with the resulting second perforations 64. Accordingly, when the proppant slurry 66 is subsequently pumped downwardly through the workstring 30 it is forcibly discharged through the gun housing perforations 62 and then outwardly through the perforations 64 aligned therewith into the production zone $Z_N$.

Since the gun 96 is not released after it is fired, the no-go structures 58 (see FIG. 1A) may be eliminated, and the check valve 56 positioned downwardly adjacent the lower end 100 of the gun 96. This shortens the necessary length of the overall workstring structure by about the length of the gun 96. Additionally, as can be seen in FIG. 4, the gun 96 does not have to create perforations in a workstring side wall surrounding it. Accordingly, more of the detonation power of the gun 96 is available for perforating the nipple 18 and the surrounding production zone $Z_N$.

Figure 2:
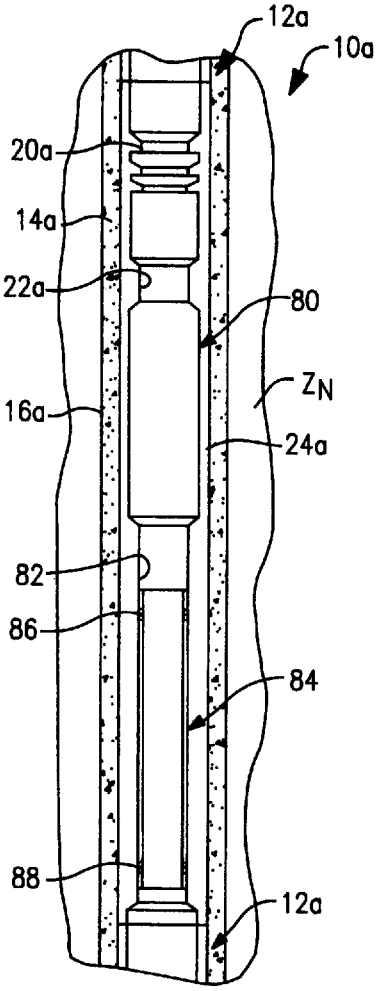
FIG. 2 is a schematic cross-sectional view similar to that in FIG. 1, but with a differently configured perforable casing nipple being installed in the wellbore casing.
Figure 2A:
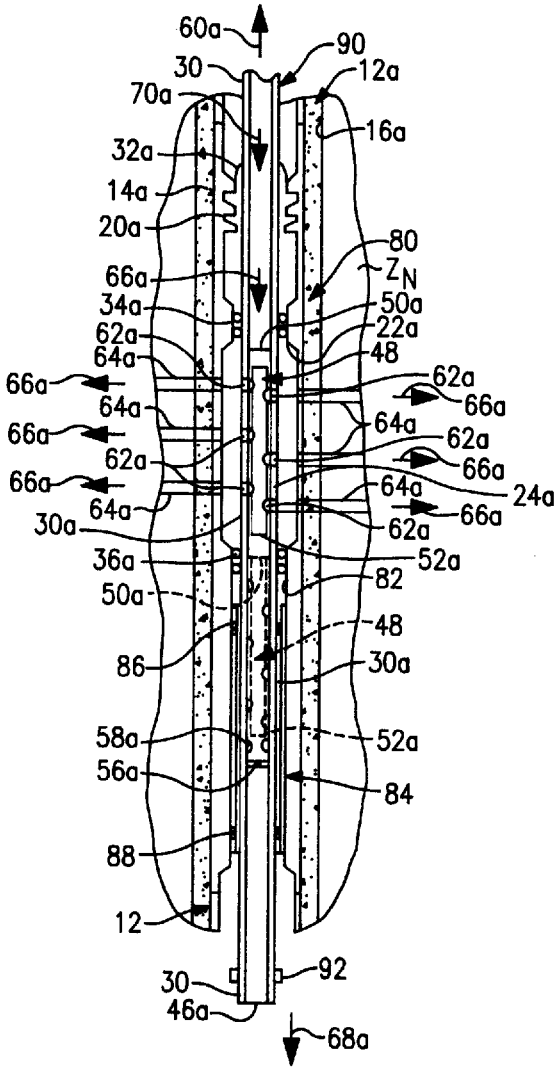
FIGS. 2A–2C are schematic cross-sectional views through the FIG. 2 perforable nipple and sequentially illustrate the performance in the well of an alternate embodiment of the perforation and proppant stimulation operation shown in FIGS. 1A–1C.
Figure 2B:
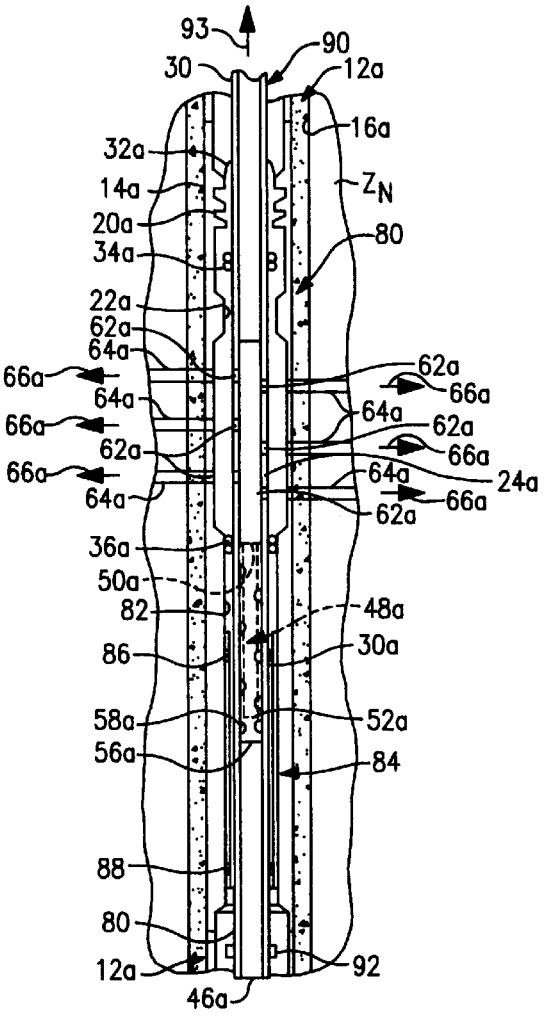
Figure 2C:
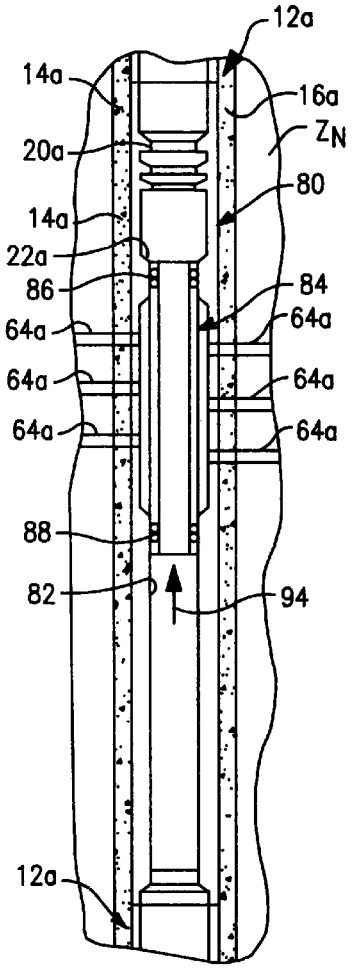

In FIGS. 2–2C an alternate embodiment of the previously described one-trip perforation and stimulation method is illustrated as being performed in a slightly modified well 10*a* (see FIG. 2). For ease in comparison, components of the well 10*a*, and the combination perforation, stimulation and isolation apparatus used in conjunction therewith, which are similar to their counterparts in FIGS. 1–1C have, for the most part, been given the same reference numerals, but with the subscripts "a".

As illustrated in FIG. 2, at each production zone Z the casing 12*a* has installed therein a modified perforable nipple structure 80 in which the perforable side wall area 24*a* extends between the top annular seal surface 22*a* and a vertically elongated lower annular seal surface area 82. Slidingly and sealingly received within the seal surface area 82 is a tubular sleeve member 84 having upper and lower annular exterior end seals 86 and 88. The nipple and sleeve structure 80,84 is similar to that illustrated and described in U.S. Pat. No. 5,361,843 entitled "DEDICATED PERFORATABLE NIPPLE WITH INTEGRAL ISOLATION SLEEVE".

Sleeve member 84 is originally installed in an open position within the nipple 80 in which the sleeve member 84 is downwardly offset from the perforable nipple side wall area 24*a* and sealingly received entirely within the lower seal surface area 82 as shown in FIG. 2. As later described herein, the sleeve member 84 is upwardly shiftable within the nipple 80 to a closed position (see FIG. 2C) in which the sleeve member side wall is positioned inwardly over the perforations 64*a*, with the upper sleeve seal 86 sealingly engaging the nipple seal surface 22*a*, and the lower sleeve seal 88 sealingly engaging the nipple seal surface 82.

As shown in FIG. 2A, to utilize this alternate one-trip method of perforating and stimulating a production zone, such as the representatively illustrated production zone $Z_N$, a modified workstring assembly 90 is provided. Workstring assembly 90 is similar to the workstring assembly 28 previously described in conjunction with FIGS. 1A–1C except that its bottom end portion (below the standing check valve 56*a*) the workstring assembly 90 does not have the locking key 38 or the screened sliding side door structure 40. Instead, the lower open end of the workstring tubing 30 has mounted thereon a conventional shifter member 92 which is operative, when pulled upwardly through the sleeve member 84, to sequentially engage the sleeve member 84, shift it upwardly to its FIG. 2C closed position within the nipple 80, and then disengage from the sleeve member 84 to leave it in its upwardly shifted closed position within the nipple 80.

The one-trip perforation and stimulation method using the workstring assembly 90 is similar to that performed using the previously described workstring assembly 28, with the exception of the final production zone isolation step that occurs in response to pulling the workstring, together with the spent perforation gun retained therein, out of the well. Specifically, as shown in FIG. 2A, the workstring assembly 90 is lowered through the casing until the locator key 32*a* is positioned below the nipple 80. The workstring assembly 90 is then pulled up until the locator key 32*a* operatively engages the locator profile 20*a* at which time the perforating gun 48*a* is vertically aligned with the perforable nipple side wall area 24*a* and the workstring tubing seals 34*a*,36*a* respectively engage the upper and lower internal nipple seal surface areas 22*a*, 82.

While an overpull force 60*a* is maintained on the portion of the workstring tubing 30 above the locator key 32*a* the gun 48*a* is fired to create the aligned perforation sets 62*a*, 64*a* after which the spent gun 48*a* automatically drops to its dotted line position within a lower section of the gun carrying portion 30*a* of the workstring tubing 30. During the continued application of the overpull force 60*a* on the workstring tubing 30, proppant slurry 66*a* is then pumped down the workstring tubing 30 and outwardly into the production zone $Z_N$ via the aligned perforation sets 62*a*,64*a* as previously described.

If desired, the optional proppant slurry cleanout step may be performed by lowering the workstring assembly 90, as indicated by the arrow 68*a* in FIG. 2A, and flushing out the casing interior with cleanout fluid 70*a* pumped down the tubing 30 and outwardly through the tubing perforations 62*a* as previously described. After the cleanout step (or after the proppant slurry pumping step if the cleanout step is not performed), the workstring tubing 30 is pulled upwardly with a force 93 (see FIG. 2B) sufficient to disable the locator key 32 and pull it upwardly through its associated nipple profile 20*a*, thereby upwardly moving the shifter member 92 upwardly toward the lower end of the shiftable sleeve member 84 as the workstring, and the spent perforating gun 48*a* retained therein, are pulled out of the well.

As previously described, as the upwardly moving shifter member 92 on the lower end of the workstring tubing 30 engages the sleeve member 84 it moves it upwardly to its closed position as indicated by the arrow 94 in FIG. 2C, and then automatically disengages from the sleeve member 84, leaving it in its closed position. In such closed position the upwardly shifted sleeve member 84 isolates the stimulated production zone $Z_N$ from the interior of the casing 12 until a suitable shifting tool (not shown) is run back down the well to engage the sleeve 84 and shift it downwardly to its FIG. 2B open position at which time production fluid from the stimulated zone $Z_N$ can flow inwardly through the perforations 64*a* and upwardly through the casing 12*a* to the earth's surface.

In the foregoing detailed description of embodiments of the present invention representatively illustrated in the accompanying figures, directional terms, such as "upper", "lower", "upward", "downward", etc. are used in relation to the representatively vertical orientation of the illustrated workstring assembly embodiments as they are depicted in the accompanying figures. It is to be understood, however, that the workstring assembly embodiments may be utilized in vertical, horizontal, inverted or inclined orientations without deviating from the principles of the present invention.

The foregoing detailed description is to be clearly understood as being given by way of illustration and example only, the spirit and scope of the present invention being limited solely by the appended claims.

What is claimed is:

1. A method of completing a well comprising the steps of:

extending a wellbore through a subterranean production zone;

positioning a perforable tubular member in the wellbore within the production zone;

lowering a tubular workstring structure into the wellbore in a manner positioning a predetermined longitudinal portion of the workstring structure within the tubular member;

creating, while the longitudinal workstring structure portion is disposed within the tubular member, a flow passage extending between the interior of the longitudinal workstring structure portion and the interior of the production zone, the flow passage being defined in part by (1) a spaced series of first perforations disposed in the longitudinal workstring structure portion, and (2) a spaced series of second perforations aligned with the first perforations and extending outwardly through the side wall of the tubular member and into the production zone; and maintaining the first perforations in the lowered longitudinal workstring portion in alignment with the second perforations while flowing a stimulating fluid through the flow passage sequentially via the interior of the tubular workstring structure, the first perforations, and the second perforations aligned with the first perforations.

2. The method of claim 1 wherein the creating step is performed using a perforating gun defining at least a portion of the longitudinal workstring structure portion.

3. The method of claim 2 wherein the creating step is performed using an exposed low debris casing gun connected at its opposite ends to facing tubing sections of the workstring structure.

4. The method of claim 1 wherein the maintaining step includes the step of creating an axial force in the workstring structure above the first perforations.

5. The method of claim 1 further comprising the step, performed subsequent to said flowing step, of permitting well fluid from the production zone to flow through the flow passage into the interior of the longitudinal workstring structure portion and then upwardly therethrough.

6. The method of claim 1 wherein the step of flowing a stimulating fluid through the flow passage is performed using a proppant slurry.

7. A method of completing a well comprising the steps of:

extending a wellbore through a subterranean production zone;

positioning a perforable nipple in a casing structure extending through a portion of the wellbore disposed within the production zone;

lowering a tubular workstring structure into the wellbore in a manner positioning a predetermined longitudinal portion of the workstring structure within the perforable nipple;

creating, while the longitudinal workstring structure portion is disposed within the perforable nipple, a flow passage extending between the interior of the longitudinal workstring structure portion and the interior of the production zone, the flow passage being defined in part by (1) a spaced series of first perforations disposed in the longitudinal workstring portion, and (2) a spaced series of second perforations aligned with the first perforations and extending outwardly through the side wall of the perforable nipple and into the production zone; and maintaining the first perforations in the lowered longitudinal workstring portion in alignment with the second perforations while flowing a fluid through the flow passage.

8. A method of completing a well comprising the steps of:

extending a wellbore through a subterranean production zone;

positioning a perforable tubular member in the wellbore within the production zone;

lowering a tubular workstring structure into the wellbore in a manner positioning a predetermined longitudinal portion of the workstring structure within the tubular member;

creating, while the longitudinal workstring structure portion is disposed within the tubular member, a flow passage extending between the interior of the longitudinal workstring structure portion and the interior of the production zone, the flow passage being defined in part by (1) a spaced series of first perforations disposed in the longitudinal workstring structure portions, and (2) a spaced series of second perforations aligned with the first perforations and extending outwardly through the side wall of the tubular member and into the production zone; and maintaining the first perforations in the lowered longitudinal workstring portion in alignment with the second perforations while flowing a fluid through the flow passage, said creating step being performed using a perforating gun defining at least a portion of the longitudinal workstring structure portion and including the steps of:

positioning the perforating gun within an outer tubing section of the longitudinal workstring structure portion, firing the gun, and longitudinally moving the fired gun downwardly past the first perforations before causing the fluid to move through the flow passage.

9. The method of claim 8 wherein:

the first perforations are formed in the outer tubing section prior to lowering the longitudinal workstring structure portion into the tubular member, the gun has a spaced series of detonation portions, and the method further comprises the step of aligning the detonation portions with the first perforations prior to firing the gun.

10. A method of completing a well comprising the steps of:

extending a wellbore through a subterranean production zone;

positioning a perforable tubular member in the wellbore within the production zone;

lowering a tubular workstring structure into the wellbore in a manner positioning a predetermined longitudinal portion of the workstring structure within the tubular member;

creating, while the longitudinal workstring structure portion is disposed within the tubular member, a flow passage extending between the interior of the longitudinal workstring structure portion and the interior of the production zone, the flow passage being defined in part by (1) a spaced series of first perforations disposed in the longitudinal workstring structure portion, and (2) a spaced series of second perforations aligned with the first perforations and extending outwardly through the side wall of the tubular member and into the production zone; and maintaining the first perforations in the lowered longitudinal workstring portion in alignment with the second perforations while flowing a fluid through the flow passage, the maintaining step including the step of creating an axial force in the workstring structure above the first perforations, the axial force being an overpull tension force.

11. A method of completing a well comprising the steps of:

extending a wellbore through a subterranean production zone;

positioning a perforable tubular member in the wellbore within the production zone;

lowering a tubular workstring structure into the wellbore in a manner positioning a predetermined longitudinal portion of the workstring structure within the tubular member;

creating, while the longitudinal workstring structure portion is disposed within the tubular member, a flow passage extending between the interior of the longitudinal workstring structure portion and the interior of the production zone, the flow passage being defined in part by (1) a spaced series of first perforations disposed in the longitudinal workstring structure portions, and (2) a spaced series of second perforations aligned with the first perforations and extending outwardly through the side wall of the tubular member and into the production zone; and maintaining the first perforations in the lowered longitudinal workstring portion in alignment with the second perforations while flowing a fluid through the flow passage, the flowing step being performed by forcing a stimulating fluid downwardly through the workstring structure, outwardly through the first perforations, and then through the second perforations into the production zone.

12. The method of claim 11 wherein the flowing step is performed using a proppant slurry.

13. The method of claim 11 further comprising the step of covering the second perforations after performing the flowing step.

14. The method of claim 13 wherein:

the method further comprises the step, performed after the flowing step, of removing at least a portion of the lowered workstring structure from the wellbore, and the covering step is performed, in response to performing the removing step and in a manner preventing appreciable fluid inflow through the second perforations into the tubular member, using a fluid control member subsequently shiftable relative to the tubular member to permit fluid inflow through the second perforations.

15. A method of completing a well comprising the steps of:

extending a wellbore through a subterranean production zone;

positioning a perforable tubular member in the wellbore within the production zone;

lowering a tubular workstring structure into the wellbore in a manner positioning a predetermined longitudinal portion of the workstring structure within the tubular member;

creating, while the longitudinal workstring structure portion is disposed within the tubular member, a flow passage extending between the interior of the longitudinal workstring portion and the interior of the production zone, the flow passage being defined in part by (1) a spaced series of first perforations disposed in the longitudinal workstring structure portion, and (2) a spaced series of second perforations aligned with the first perforations and extending outwardly through the side wall of the tubular member and into the production zone; and maintaining the first perforations in the lowered longitudinal workstring portion in alignment with the second perforations while flowing a fluid through the flow passage, the method further comprising the steps, performed after the flowing step, of:

further lowering the longitudinal workstring structure portion, and forcing a cleaning fluid downwardly through the workstring structure and outwardly through the first perforations.

16. A one-trip method of perforating and stimulating a subterranean well production zone, the method comprising the steps of:

extending a wellbore through the production zone;

forming a casing within the wellbore, the casing having a perforable nipple portion disposed within the production zone;

supporting a perforating gun on a tubular workstring structure having, below the supported gun, a structure configured to permit upward fluid flow therethrough and preclude downward fluid flow therethrough, the supported gun at least partially defining a longitudinal portion of the workstring structure;

positioning the longitudinal workstring structure portion within the nipple;

firing the perforating gun in a manner creating, while the longitudinal workstring structure portion is disposed within the nipple, a flow passage extending between the interior of the longitudinal workstring structure portion and the interior of the production zone, the flow passage being defined in part by (1) a spaced series of first perforations disposed in the longitudinal workstring structure portion, and (2) a spaced series of second perforations aligned with the first perforations and extending outwardly through the side wall of the nipple and into the production zone;

maintaining an axial force in the portion of the workstring structure disposed above the longitudinal portion thereof, in a manner maintaining the first perforations in alignment with the second perforations, while flowing a pressurized stimulating fluid downwardly through the workstring structure, outwardly through the first perforations, and then through the second perforations into the production zone;

removing at least an upper portion of the workstring structure, after completion of the flowing step; and covering the second perforations, in response to performing the removing step and in a manner preventing appreciable fluid inflow through the second perforations into the nipple and upwardly through the casing, with a fluid control member subsequently shiftable relative to the nipple to permit fluid inflow through the second perforations and upwardly through the casing.

17. The one-trip method of claim 16 wherein:

the nipple has an interior locator profile therein, and the positioning step is performed by:

mounting a locator key on the workstring above the longitudinal portion thereof in which the gun is supported, lowering the locator key through the nipple profile, and raising the locator key back into the nipple profile to releasably preclude upward movement of the key through the profile.

18. The one-trip method of claim 17 wherein:

the maintaining step is performed by creating an axial force in the portion of the workstring structure above the locator key.

19. The one-trip method of claim 18 wherein:

the maintaining step is performed by creating an overpull tension force in the portion of the workstring structure above the locator key.

20. The one-trip method of claim 17 wherein:

the removing step includes the step of exerting in the portion of the workstring above the locator key a tensile force sufficient to disable the locator key and permit it to pass upwardly through the nipple profile.

21. The one-trip method of claim 16 wherein:

the fluid control member is mounted on a lower end portion of the workstring below the longitudinal workstring portion in which the gun is supported, and the covering step includes the step of leaving the fluid control member in the nipple in response to the performance of the removing step.

22. The one-trip method of claim 21 wherein the leaving step includes the steps of:

mounting a locking key member on the workstring between the shiftable fluid control member and the longitudinal workstring portion in which the gun is supported, placing a releasable connection structure in the workstring between the locking key member and the longitudinal workstring portion in which the gun is supported, locking the locking key into the nipple profile as the workstring is moved upwardly through the casing during the removing step, and separating adjacent workstring portions at the releasable connection subsequent to performing the locking step.

23. The one-trip method of claim 22 wherein:

the covering step is performed using a sliding side door structure.

24. The one-trip method of claim 16 wherein:

the nipple has a perforable side wall section in which the first perforations are to be formed, the fluid control member is disposed within the nipple in an open position in which the fluid control member is downwardly offset from the perforable nipple side wall section, the fluid control member being upwardly shiftable to a closed position in which it inwardly overlaps the perforable nipple side wall section, and the covering step includes the step of upwardly shifting the fluid control member to its closed position in response to the performance of the covering step.

25. The one-trip method of claim 24 wherein:

the fluid control member is a shiftable tubular sleeve coaxially and sealingly disposed within the nipple, the method further comprises the step of mounting a shifter member on the workstring below the longitudinal portion thereof in which the gun is supported, the removing step is performed by removing the entire workstring from the casing, and the covering step includes the step of causing the shifter member to sequentially engage, upwardly shift and then disengage from the sleeve during the removal step.

26. The one-trip method of claim 16 further comprising the steps, performed after the flowing step and before the removing step, of:

further lowering the workstring structure, and forcing a cleaning fluid downwardly through the workstring structure and outwardly through the first perforations.

27. The one-trip method of claim 16 wherein:

the supporting step includes the step of positioning the perforating gun within an outer tubing section of the longitudinal workstring structure portion, and the method further comprises the steps of causing the fired gun to drop through the workstring structure and be retained therein at a position below the first perforations.

28. The one-trip method of claim 27 wherein:

The first perforations are formed in the outer tubing section prior to lowering the longitudinal workstring structure portion into the nipple.

29. The one-trip method of claim 16 wherein the supporting step is performed using an exposed low debris type casing gun connected at its opposite ends to facing tubing sections of the workstring structure.

30. Subterranean well production zone perforation apparatus comprising:

a tubular structure;

a perforating gun supported on the tubular structure;

a check valve mounted in the tubular structure and operative to permit fluid flow into the tubular structure and preclude fluid flow outwardly therefrom; and a locator device exteriorly mounted on the tubular structure proximate to the supported gun and operatively engageable with an interior profile on a perforable casing nipple to permit travel of the locator device in one axial direction therethrough and releasably preclude subsequent return therethrough in the opposite axial direction.

31. The apparatus of claim 30 wherein the perforating gun is a drop-off type perforating gun supported within the tubular structure to drop downwardly therethrough in response to firing of the gun.

32. The apparatus of claim 31 further comprising:

a catch projection disposed in the tubular structure and positioned between the bottom of the supported gun and the check valve, the catch projection being operative to catch the dropped gun and preclude further downward travel thereof through the tubular structure.

33. The apparatus of claim 32 wherein:

the supported gun has an axial length, a top end and a bottom end, and the catch projection is spaced downwardly apart from the bottom end of the supported gun a distance at least equal to the axial length of the supported gun.

34. The apparatus of claim 31 wherein:

the tubular structure has a spaced series of side wall perforations therein, and the perforating gun has a spaced series of detonation portions disposed thereon and inwardly aligned with the side wall perforations.

35. The apparatus of claim 30 wherein the perforating gun is an exposed low debris type casing gun connected at its opposite ends to facing ends of axially spaced sections of the tubular structure.

36. The apparatus of claim 30 wherein the tubular structure has a bottom end section extending downwardly beyond the check valve.

37. The apparatus of claim 36 wherein the bottom end section has an open lower end.

38. The apparatus of claim 36 wherein, from top to bottom along its length, the bottom end section of the tubular structure has mounted thereon:

a releasable connection structure, a locking type locator device, and a shiftable fluid flow control device.

39. The apparatus of claim 38 wherein the shiftable fluid flow control device is a sliding side door structure.

40. The apparatus of claim 36 wherein the bottom end section of the tubular structure has mounted thereon a tubular closure sleeve shifter member.

41. The apparatus of claim 30 wherein said check valve is mounted in a downwardly spaced relationship with the supported gun.

42. The apparatus of claim 30 wherein said locator device is a locator key.

43. The apparatus of claim 30 wherein said locator device is mounted above the supported gun.

* * * * *